US011104150B2

(12) United States Patent
O'Hara et al.

(10) Patent No.: US 11,104,150 B2
(45) Date of Patent: Aug. 31, 2021

(54) VALVE HOUSING ROTATION PREVENTION

(71) Applicant: Hewlett-Packard Development Company, L.P., Spring, TX (US)

(72) Inventors: Steve A. O'Hara, Vancouver, WA (US); Kenneth Williams, Vancouver, WA (US); Wesley R. Schalk, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/767,314

(22) PCT Filed: Aug. 30, 2018

(86) PCT No.: PCT/US2018/048798
§ 371 (c)(1),
(2) Date: May 27, 2020

(87) PCT Pub. No.: WO2020/046329
PCT Pub. Date: Mar. 5, 2020

(65) Prior Publication Data

US 2020/0406629 A1 Dec. 31, 2020

(51) Int. Cl.

| | |
|---|---|
| ***G03G 15/00*** | (2006.01) |
| ***B41J 2/00*** | (2006.01) |
| ***B67C 3/00*** | (2006.01) |
| ***B41J 2/175*** | (2006.01) |
| ***G03G 15/08*** | (2006.01) |
| ***B67C 3/26*** | (2006.01) |
| ***B67C 3/28*** | (2006.01) |
| ***G03G 15/10*** | (2006.01) |

(52) U.S. Cl.
CPC ..... *B41J 2/17596* (2013.01); *B41J 2/1752* (2013.01); *B67C 3/264* (2013.01); *B67C 3/28* (2013.01); *G03G 15/0877* (2013.01); *G03G 15/0886* (2013.01); *G03G 15/104* (2013.01)

(58) Field of Classification Search
CPC ..... G03G 15/104; G03G 15/0877; G03G 15/0886; B41J 2/17596; B41J 2/17503; B41J 2/1752; B67C 3/2617; B67C 3/28; B67C 3/2637; B67C 3/264
USPC ..... 399/238; 347/85, 86
See application file for complete search history.

(56) References Cited

U.S. PATENT DOCUMENTS 2,743,047 A * 4/1956 Clarke ..... B67C 3/2617 141/6
5,085,255 A * 2/1992 LaWarre, Sr. ..... B67C 3/2628 141/147

(Continued)

FOREIGN PATENT DOCUMENTS

| | | | |
|---|---|---|---|
| CN | 102785481 | A | 11/2012 |
| EP | 2395399 | A3 | 4/2017 |
| JP | 4811013 | B2 | 11/2011 |

*Primary Examiner* — Robert B Beatty
(74) *Attorney, Agent, or Firm* — Brooks Cameron & Huebsch PLLC

(57) ABSTRACT

In some examples, an apparatus can include a pawl including an anti-rotation surface and a spring, and a valve housing including a wedge, where the spring biases the pawl to a first position in response to the valve housing being at a closed position such that the wedge of the valve housing contacts the anti-rotation surface of the pawl to prevent rotation of the valve housing at the first position of the pawl.

15 Claims, 5 Drawing Sheets

(56) References Cited

U.S. PATENT DOCUMENTS

| | | | | |
|---|---|---|---|---|
| 5,481,344 | A * | 1/1996 | Yasuda | G03G 15/087 222/DIG. 1 |
| 5,614,996 | A | 3/1997 | Tanda | |
| 5,903,293 | A * | 5/1999 | Nikkels | B41J 2/175 347/86 |
| 6,076,920 | A | 6/2000 | Zapata et al. | |
| 7,255,430 | B2 | 8/2007 | Silverbrook et al. | |
| 7,303,267 | B2 | 12/2007 | Yuen | |
| 7,377,626 | B2 | 5/2008 | Holland et al. | |
| 7,431,437 | B2 | 10/2008 | Wilson, II et al. | |
| 2003/0081969 | A1 | 5/2003 | Muramatsu | |
| 2006/0238582 | A1 | 10/2006 | Silverbrook | |
| 2007/0081833 | A1 | 4/2007 | Koyama | |
| 2017/0016532 | A1 | 1/2017 | Yasnogorodskiy | |
| 2018/0104957 | A1 | 4/2018 | Rietbergen et al. | |
| 2020/0384776 | A1 * | 12/2020 | O'Hara | B41J 2/17523 |
| 2020/0398582 | A1 * | 12/2020 | O'Hara | B41J 2/175 |

* cited by examiner

VALVE HOUSING ROTATION PREVENTION

BACKGROUND

Imaging systems, such as printers, copiers, etc., may be used to form markings on a physical medium, such as text, images, etc. In some examples, imaging systems may form markings on the physical medium by performing a print job. A print job can include forming markings such as text and/or images by transferring a print substance (e.g., ink, toner, etc.) to the physical medium.

DETAILED DESCRIPTION

Imaging devices may include a supply of a print substance located in a reservoir. As used herein, the term "print substance" refers to a substance which, when applied to a medium, can form representation(s) (e.g., text, images models, etc.) on the medium during a print job of a two-dimensional printer or be applied in successive layers to form three-dimensional objects during a print job of a three-dimensional printer.

The print substance can be deposited onto a physical medium. As used herein, the term "imaging device" refers to any hardware device with functionalities to physically produce representation(s) (e.g., text, images, models, etc.) on the medium. In some examples, a "medium" may include paper, photopolymers, plastics, composite, metal, wood, or the like.

The reservoir including the print substance may be inside of the imaging device and include a supply of the print substance such that the imaging device may draw the print substance from the reservoir as the imaging device creates the images on the print medium. As used herein, the term "reservoir" refers to a container, a tank, and/or a similar vessel to store a supply of the print substance for use by the imaging device.

As the imaging device draws the print substance from the reservoir, the amount of print substance in the reservoir may deplete. As a result, the amount of print substance in the reservoir of the imaging device may have to be replenished.

A print substance supply may be utilized to fill and/or refill the reservoir of the imaging device with print substance. During a fill and/or refill operation, the print substance supply can transfer print substance from the print substance supply to the reservoir of the imaging device. However, if the print substance supply is disturbed prior to completing the fill and/or refill operation, print substance may be spilled outside of the imaging device reservoir.

Additionally, allowing a valve of the print substance supply to be engaged while not connected to the imaging device may cause print substance to be spilled outside of the imaging device reservoir.

Accordingly, valve housing rotation prevention can prevent the valve of the print substance supply from being engaged while not connected to the imaging device. For example, the valve housing of the print substance supply is unable to be engaged to allow transfer of print substance unless the print substance supply is in contact with the imaging device. Additionally, valve housing rotation prevention can prevent the print substance supply from being disturbed (e.g., moved) from the surface of the imaging device while the valve of the print substance supply is engaged. For example, while the valve of the print substance supply is engaged (e.g., opened) and the print substance supply is transferring print substance to the reservoir of the imaging device, the print substance supply can be prevented from being disturbed.

Figure 1:
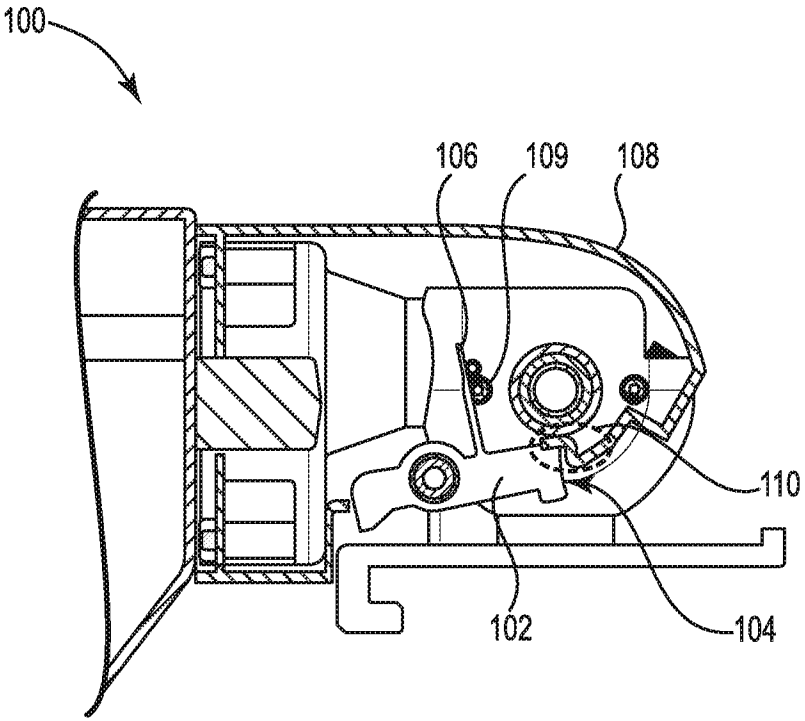
FIG. 1 illustrates an example of an apparatus including a valve housing in a closed position and a pawl in a first position consistent with the disclosure.

FIG. 1 illustrates an example of an apparatus 100 including a valve housing 108 in a closed position and a pawl 102 in a first position consistent with the disclosure. Apparatus 100 can include a valve housing 108. The valve housing 108 can include a pawl 102, first wedge 110, and member 109.

Pawl 102 can include anti-rotation surface 104 and spring 106. As used herein, the term "pawl" refers to a pivotable curved bar in a mechanical linkage. For example, pawl 102 can pivot when a force is applied to pawl 102, as is further described herein. As used herein, the term "anti-rotation surface" refers to an exterior face of pawl 102 that prevents rotation of another piece in a mechanical linkage. For example, anti-rotation surface 104 of pawl 102 can prevent rotation of valve housing 108, as is further described herein.

As illustrated in FIG. 1, pawl 102 can be included in valve housing 108. As used herein, the term "valve housing" refers to a casing and/or support for a mechanism. For example, valve housing 108 can include be a casing that houses a valve to allow transfer of print substance (e.g., not shown in FIG. 1) from a print substance supply (e.g., connected to valve housing 108 but not shown in FIG. 1) to an imaging device (e.g., as is further described in connection with FIG. 4), In the orientation illustrated in FIG. 1, valve housing 108 is in a closed position. In the closed position, valve housing 108 does not allow any transfer of print substance from the print substance supply, as is further described herein.

Pawl 102 can include spring 106. As used herein, the term "spring" refers to a device that stores mechanical energy. Spring 106 can contact member 109 of valve housing 108. As used herein, the term "member" refers to a rigid piece of a mechanical device. For example, member 109 can protrude from valve housing 108 such that spring 106 contacts member 109.

Spring 106 can be a leaf spring. As used herein, the term "leaf spring" refers to a spring that stores mechanical energy when it is subjected to an external load applied perpendicularly to a longitudinal axis of the spring. For example, spring 106 can store mechanical energy as a result of a load applied to spring 106 by member 109 when spring 106 is rotated (e.g., as is further described in connection with FIGS. 2 and 3).

Although spring 106 is described above as being a leaf spring, examples of the disclosure are not so limited. For example, spring 106 can be a tension/extension spring, torsion spring, cantilever spring, coil spring, gas spring, among other types of springs.

Spring 106 can bias pawl 102 to a first position of pawl 102. For example, in the orientation illustrated in FIG. 1, there is little to no load applied to spring 106, resulting in pawl 102 being biased to the first position of pawl 102.

Valve housing 108 can include first wedge 110. As used herein, the term "wedge" refers to a piece of material to hold an object in a particular position. For example, as illustrated in FIG. 1, first wedge 110 contacts anti-rotation surface 104 of pawl 102. As a result of first wedge 110 contacting anti-rotation surface 104 of pawl 102, clockwise rotation of valve housing 108 is prevented at the first position of pawl 102.

As a result of valve housing 108 being unable to be rotated (e.g., unable to be rotated clockwise, as oriented in FIG. 1) from the closed position as illustrated in FIG. 1 when pawl 102 is at the first position, the valve is unable to be opened. The valve being closed can prevent transfer of print substance from the print substance supply when the print substance supply is not connected to (e.g., contacting) a surface of an imaging device, as is further described in connection with FIGS. 2-4.

Figure 2:
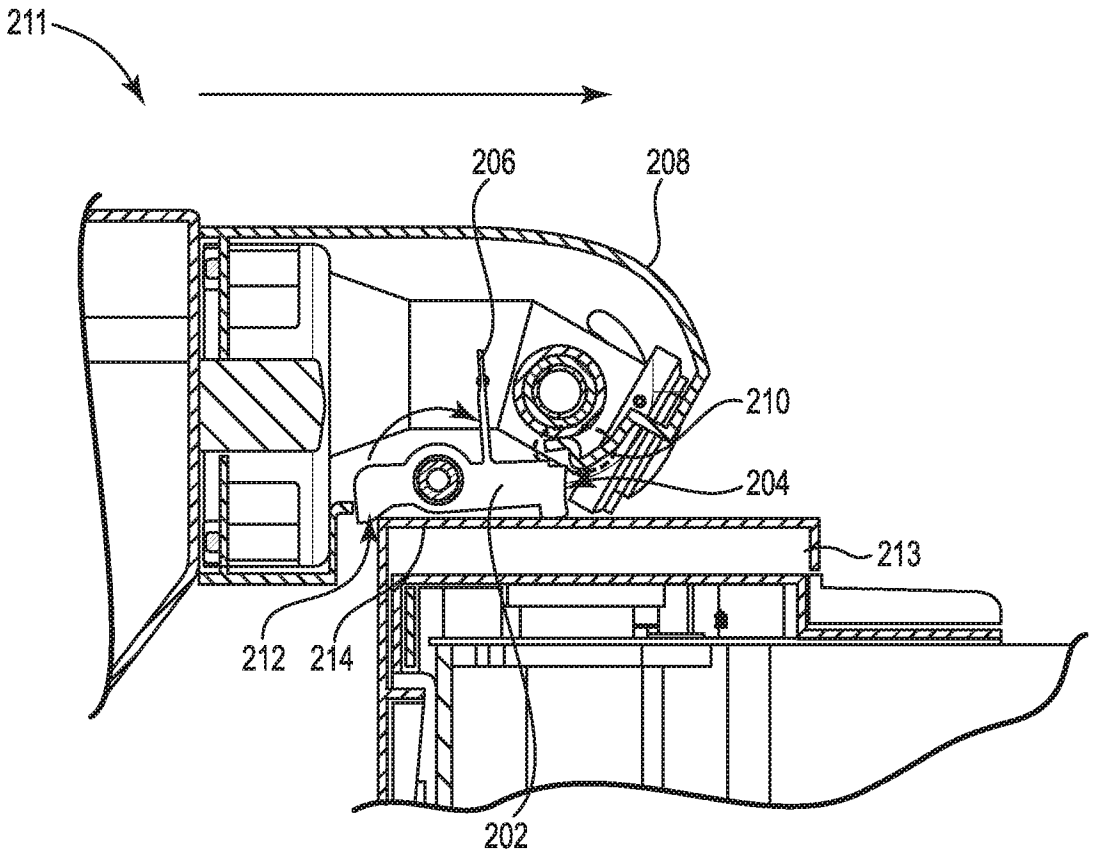
FIG. 2 illustrates an example of a system including a valve housing in a closed position consistent with the disclosure.

FIG. 2 illustrates an example of a system 211 including a valve housing 208 in a closed position consistent with the disclosure. The system 211 can include valve housing 208, imaging device 213, and surface 214 of imaging device 213. Valve housing 208 can include pawl 202 and first wedge 210. Pawl 202 can include anti-rotation surface 204, spring 206, and angled surface 212.

As illustrated in FIG. 2, valve housing 208 is beginning to contact surface 214 of imaging device 213, as is further described herein. As used herein, the term "surface of imaging device" refers to an exterior face of imaging device 213.

Pawl 202 can include angled surface 212. As used herein, the term "angled surface" refers to an exterior face of pawl 202 that is oriented at an angle from the remaining portion of pawl 202.

As illustrated in FIG. 2, valve housing 208 can experience translational motion (e.g., as indicated in FIG. 2) relative to imaging device 213. For instance, valve housing 208 can be located adjacent to surface 214 of imaging device 213 and experience a translational motion relative to imaging device 213. The translational motion illustrated in FIG. 2 can be a portion of motion of the valve housing 208 to secure valve housing 208 to imaging device 213 to transfer print substance from a print substance supply to imaging device 213.

The translational motion illustrated in FIG. 2 can cause angled surface 212 of pawl 202 to contact surface 214 of imaging device 213. The contact between angled surface 212 and surface 214 can cause pawl 202 to begin to rotate (e.g., in a clockwise direction as oriented in FIG. 2). As pawl 202 begins to rotate, spring 206 can begin to deflect.

As pawl 202 begins to rotate in the clockwise direction, anti-rotation surface 204 begins to rotate away from first wedge 210. As the translational motion illustrated in FIG. 2 progresses, anti-rotation surface 204 can clear first wedge 210, allowing valve housing 208 to be rotated, as is further described in connection with FIG. 4.

Figure 3:
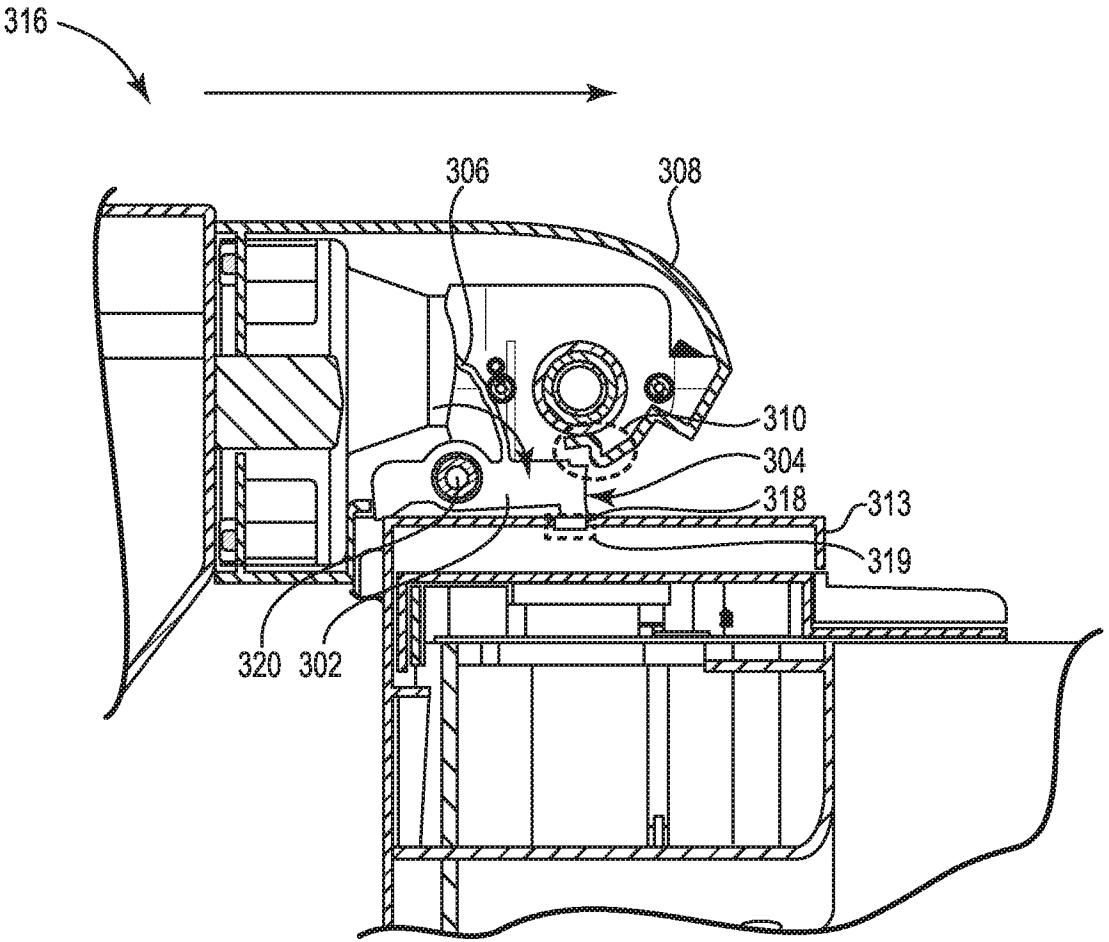
FIG. 3 illustrates an example of a system including a valve housing in a closed position and a pawl in a second position consistent with the disclosure.

FIG. 3 illustrates an example of a system 316 including a valve housing 308 in a closed position and a pawl 302 in a second position consistent with the disclosure. The system 316 can include valve housing 308, imaging device 313, and slot 319 of imaging device 313. Valve housing 308 can include pawl 302 and first wedge 310. Pawl 302 can include anti-rotation surface 304, spring 306, anti-translation protrusion 318, and pawl axle 320.

As previously described in connection with FIG. 3, pawl 302 can include an angled surface. The angled surface of pawl 302 can contact a surface of imaging device 313 as valve housing 308 experiences a translational motion (e.g., as indicated in FIG. 3). The translational motion illustrated in FIG. 3 can be a portion of motion of the valve housing 308 to secure valve housing 308 to imaging device 313 to transfer print substance from a print substance supply to imaging device 313.

The translational motion illustrated in FIG. 3 can cause the angled surface of pawl 302 to continue to contact the surface of imaging device 313, causing pawl 302 to continue to rotate (e.g., in a clockwise direction as oriented in FIG. 3). As pawl 302 continues to rotate in the clockwise direction (e.g., due to the translational motion of valve housing 308), anti-rotation surface 304 rotates away from first wedge 310 until pawl 302 is in a second position. The translational motion causing pawl 302 to rotate can cause spring 306 to deflect.

As pawl 302 rotates from the first position to the second position, the anti-rotation surface 304 of pawl 302 rotates away from first wedge 310 of valve housing 308. For example, rotation of pawl 302 causes anti-rotation surface 304 to rotate away from first wedge 310 such that, when pawl 302 reaches the second position (e.g., as illustrated in FIG. 3), anti-rotation surface 304 no longer contacts first wedge 310. Since first wedge 310 no longer contacts anti-rotation surface 304 when pawl 302 is in the second position, valve housing 308 can be rotated from the closed position to an open position, as is further described in connection with FIG. 4.

Pawl 302 can rotate about a pawl axle 320. As used herein, the term "axle" refers to a central shaft for a rotating piece of material. Pawl 302 can rotate about pawl axle 320 to the second position of pawl 302 such that the anti-rotation surface 304 rotates away from first wedge 310.

Pawl 302 can include an anti-translation protrusion 318. As used herein, the term "anti-translation protrusion" refers to a member projecting from pawl 302 to prevent translation of another piece in a mechanical linkage. For example, anti-translation protrusion 318 can prevent translational motion of valve housing 308, as is further described herein.

As pawl 302 rotates about pawl axle 320, anti-translation protrusion 318 can be rotated into a slot 319 of imaging device 313. As used herein, the term "slot" refers to an opening, such as a groove, notch, slit, etc. The slot 319 can be located in a surface of imaging device 313 which is adjacent to valve housing 308. For example, slot 319 can be located adjacent to valve housing 308 such that anti-translation protrusion 318 of pawl 302 rotates into slot 319 as pawl 302 is rotated from the first position to the second position.

Anti-translation protrusion 318 can be located in slot 319 when pawl 302 is in the second position to prevent translational motion of valve housing 308. For example, a surface of anti-translation protrusion 318 can contact an inner surface of slot 319 if translational motion of valve housing 308 is attempted when valve housing 308 is in an open position, as is further described in connection with FIG. 4.

Figure 4:
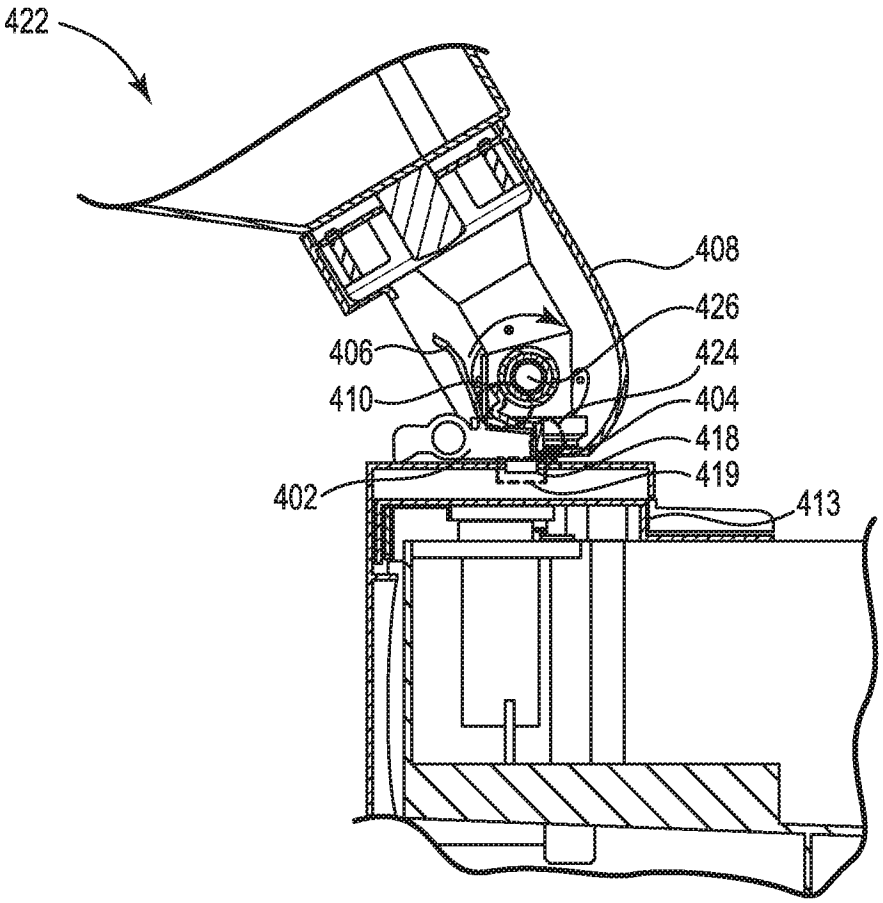
FIG. 4 illustrates an example of a print substance supply including a valve housing in an open position consistent with the disclosure.

FIG. 4 illustrates an example of a print substance supply 422 including a valve housing 408 in an open position consistent with the disclosure. Print substance supply 422 can include valve housing 408, where valve housing 408 can include pawl 402, first wedge 410, and second wedge 424. Pawl 402 can include anti-rotation surface 404, spring 406, and anti-translation protrusion 418. Also illustrated in FIG. 4 is imaging device 413. Imaging device 413 can include slot 419.

As previously described in connection with FIG. 3, rotation of pawl 402 to the second position of pawl 402 causes anti-rotation surface 404 to rotate away from first wedge 410 such that, when pawl 402 reaches the second position (e.g., as illustrated in FIG. 4), anti-rotation surface 404 no longer contacts first wedge 410. As a result, valve housing 408 can rotate from the closed position (e.g., as previously illustrated in FIGS. 1-3) to an open position (e.g., as illustrated in FIG. 4).

Valve housing 408 can be rotated from the closed position to the open position about supply axle 426. The rotation of valve housing 408 from the closed position to the open position can be in a clockwise direction, as oriented in FIG. 4.

Valve housing 408 can be rotated in a clockwise direction until the second wedge 424 contacts anti-rotation surface 404 of pawl 402. For example, the anti-rotation surface 404 can contact second wedge 424 when valve housing 408 is at the open position. Second wedge 424 can contact anti-rotation surface 404 of pawl 402 in order to stop rotation of valve housing 408, which can prevent over-rotation and/or damage to the valve. Further, stopping rotation of valve housing 408 via second wedge 424 and anti-rotation surface 404 can provide a user a tactile feedback to let the user know when the valve is in the open position.

As previously described in connection with FIG. 3, pawl 402 includes anti-translation protrusion 418. As pawl 402 is rotated from the first position to the second position, anti-translation protrusion 418 can correspondingly be rotated such that, when pawl 402 is at the second position, anti-translation protrusion 418 is located in slot 419 of imaging device 413.

When valve housing 408 is in the open position, a portion of second wedge 424 can provide a load acting on a top portion of pawl 402 to keep anti-translation protrusion 418 located in slot 419. For example, a load generated by valve housing 408 when valve housing 408 is in the open position can be applied to a portion of pawl 402 located above anti-translation protrusion 418 such that anti-translation protrusion 418 is forced to stay located in slot 419 when valve housing 408 is in the open position.

Anti-translation protrusion 418 can prevent translational motion of valve housing 408. For example, if a user were to attempt to translate (e.g., slide) valve housing 408 away from imaging device 413 while valve housing 408 is in the open position, anti-translation protrusion 418 can contact an inner surface of slot 419, preventing translational motion of valve housing 408.

Transfer of print substance from print substance supply 422 to imaging device 413 can occur when valve housing 408 is in the open position. Preventing translational motion of valve housing 408 when valve housing 408 is in the open position can prevent print substance from being spilled outside of imaging device 413 during a fill and/or refill operation.

When the fill and/or refill operation is concluded, print substance supply 422 can be removed from imaging device 413. For example, valve housing 408 can be rotated in a counter-clockwise direction, as oriented in FIG. 4, from the open position to the closed position. As a result of valve housing 408 being in the closed position, the load acting on the top portion of pawl 402 is removed, allowing rotation of pawl 402.

In response to a sufficient translational motion of print fluid supply 422 away from imaging device 413, pawl 402 can be rotated in a counter-clockwise direction from the second position to the first position. As a result of pawl 402 being in the first position, anti-translation protrusion 418 is removed from slot 419 of imaging device 413, allowing print substance supply 422 to be fully removed from imaging device 413, When the angled surface (e.g., angled surface 212, previously described in connection with FIG. 2) of pawl 402 is no longer in contact with the surface (e.g., surface 214, previously described in connection with FIG. 2) of imaging device 413, spring 406 can cause pawl 402 to be rotated from the second position to the first position.

As print substance supply 422 is removed from imaging device 413, pawl 402 can be rotated from the second position to the first position via spring 406. For example, as a result of a load applied to spring 406 when pawl 402 is in the second position, spring 406 can be deflected (e.g., as previously illustrated in FIG. 3 and illustrated in FIG. 4). As print substance supply 422 is removed from imaging device 413, and as the angled surface of pawl 402 begins to disengage (e.g., lose contact) from the surface of imaging device 413, the load applied to spring 406 slowly decreases, causing spring 406 to rotate pawl 402 from the second position back to the first position.

An apparatus providing valve housing rotation prevention can allow for a fill and/or refill operation of an imaging device reservoir with print substance. The valve included in the valve housing can be prevented from being engaged while not connected to the imaging device. Additionally, when the valve housing is connected to the imaging device, the valve housing is unable to be moved during the fill and/or refill operation until the valve housing is closed. Prevention of the valve from being engaged while not connected to the imaging device, as well as preventing the valve housing from movement during a fill and/or refill operation (e.g., while the valve is open/engaged) can prevent print substance from being spilled outside of the imaging device reservoir.

Figure 5:
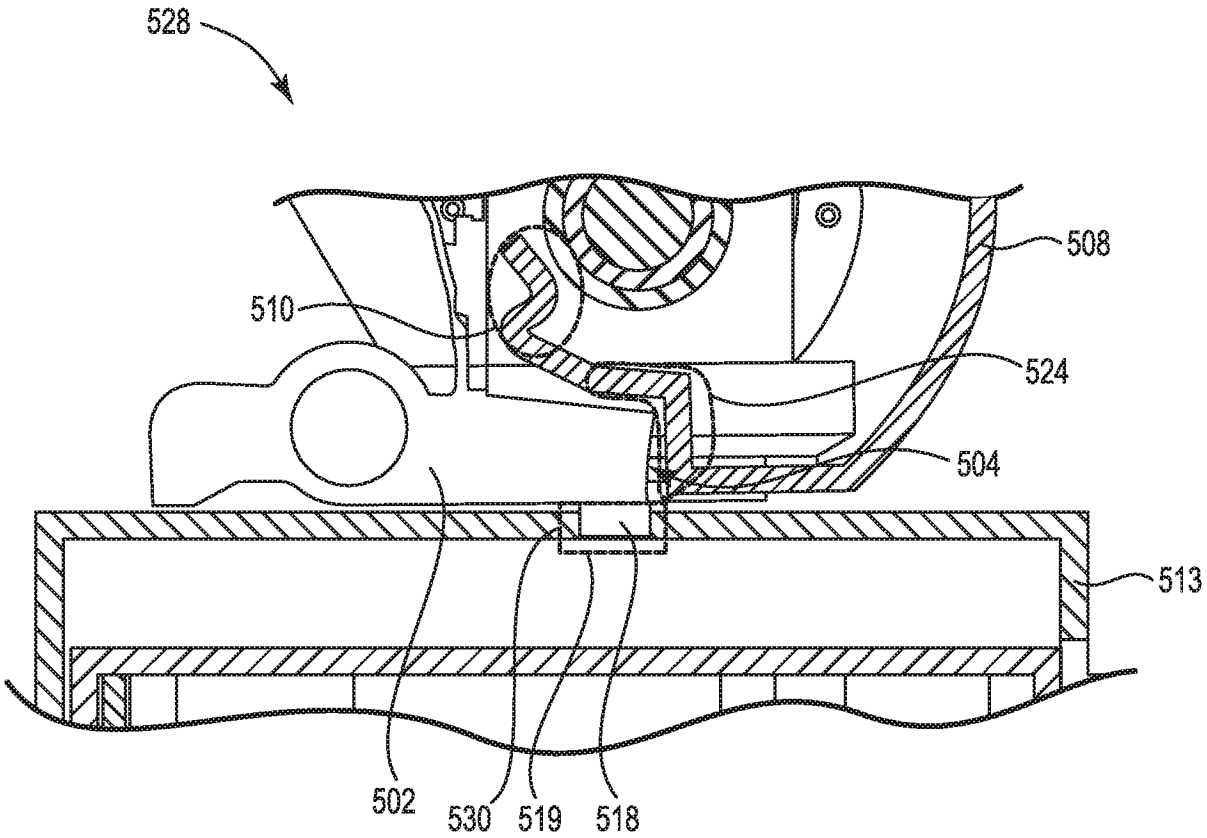
FIG. 5 illustrates an example of a portion of a system including a valve housing in an open position and a pawl in a second position consistent with the disclosure.

FIG. 5 illustrates an example of a portion of a system 528 including a valve housing 508 in an open position and a pawl 502 in a second position consistent with the disclosure. System 528 can include a valve housing 508, where valve housing 508 can include pawl 502, first wedge 510, and second wedge 524. Pawl 502 can include anti-rotation surface 504, and anti-translation protrusion 518. Also illustrated in FIG. 5 is imaging device 513. Imaging device 513 can include slot 519.

Valve housing 508 can be in an open position, as illustrated in FIG. 5. In the open position of valve housing 508, anti-rotation surface 504 can contact second wedge 524. Second wedge 524 can contact anti-rotation surface 504 of pawl 502 in order to stop rotation of valve housing 508.

Pawl 502 can include anti-translation protrusion 518. Pawl 502 can be rotated from the first position to the second position such that anti-translation protrusion 518 can correspondingly be rotated. Anti-translation protrusion 518 can be rotated such that, when pawl 502 is at the second position, anti-translation protrusion 518 is located in slot 519 of imaging device 513.

When valve housing 508 is in the open position, a portion of second wedge 524 can provide a load acting on top portion of pawl 502. For example, as illustrated in FIG. 5, the load can act in a downwards orientation as system 528 is oriented in FIG. 5.

The downward acting load on pawl 502 can be at a location on pawl 502 that is located above anti-translation protrusion 518. The downward acting load on pawl 502 can force anti-translation protrusion 518 to stay located in slot 519 when valve housing 508 is in the open position.

Anti-translation protrusion 518 can prevent translational movement of valve housing 508 when valve housing 508 is in the open position. For example, if a user were to attempt to translate (e.g., slide) valve housing 508 away from imaging device 513 while valve housing 508 is in the open position, anti-translation protrusion 518 can contact an inner surface 530 of slot 519. The inner surface 530 of slot 519 contacting anti-translation protrusion 518 can prevent translational motion of valve housing 508 when valve housing 508 is in the open position.

In the foregoing detailed description of the disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the disclosure. Further, as used herein, "a" can refer to one such thing or more than one such thing.

The figures herein follow a numbering convention in which the first digit corresponds to the drawing figure number and the remaining digits identify an element or component in the drawing. For example, reference numeral 102 may refer to element 102 in FIG. 1 and an analogous element may be identified by reference numeral 202 in FIG. 2. Elements shown in the various figures herein can be added, exchanged, and/or eliminated to provide additional examples of the disclosure. In addition, the proportion and the relative scale of the elements provided in the figures are intended to illustrate the examples of the disclosure and should not be taken in a limiting sense.

It can be understood that when an element is referred to as being "on," "connected to", "coupled to", or "coupled with" another element, it can be directly on, connected, or coupled with the other element or intervening elements may be present. In contrast, when an object is "directly coupled to" or "directly coupled with" another element it is understood that are no intervening elements (adhesives, screws, other elements) etc.

The above specification, examples and data provide a description of the method and applications, and use of the system and method of the disclosure. Since many examples can be made without departing from the spirit and scope of the system and method of the disclosure, this specification merely sets forth some of the many possible example configurations and implementations,

What is claimed is:

1. An apparatus, comprising:

a pawl including an anti-rotation surface and a spring; and a valve housing including a wedge;

wherein the spring biases the pawl to a first position in response to the valve housing being at a closed position such that the wedge of the valve housing contacts the anti-rotation surface of the pawl to prevent rotation of the valve housing at the first position of the pawl.

2. The apparatus of claim 1, wherein:

the pawl includes an angled surface; and the pawl rotates from the first position to a second position in response to the angled surface of the pawl contacting a surface of an imaging device.

3. The apparatus of claim 2, wherein the rotation of the pawl from the first position to the second position causes the anti-rotation surface of the pawl to rotate away from the wedge of the valve housing such that the valve housing is rotated from the closed position to an open position.

4. The apparatus of claim 2; wherein the pawl rotates from the first position to the second position as a result of a translational motion of the apparatus causing the angled surface of the pawl to contact the surface of the imaging device.

5. The apparatus of claim 1, wherein the spring contacts a member of the valve housing to bias the pawl to the first position.

6. The apparatus of claim 1; wherein the spring is a leaf spring.

7. A system, comprising:

a valve housing, including a first wedge and a second wedge; and a pawl, including:

an anti-rotation surface that contacts the first wedge to prevent rotation of the valve housing in response to the valve housing being at a closed position;

an angled surface; and a leaf spring to bias the pawl to a first position in response to the valve housing being at the closed position;

wherein the pawl rotates from the first position to a second position in response to the angled surface of the pawl contacting a surface of an imaging device.

8. The system of claim 7, wherein the pawl rotates about a pawl axle to the second position to cause the anti-rotation surface of the pawl to rotate away from the first wedge of the valve housing such that the valve housing is rotated from the closed position to an open position.

9. The system of claim 8, wherein the anti-rotation surface of the pawl contacts the second wedge in response to the pawl being at the second position to prevent rotation of the valve housing at the open position of the valve housing.

10. The system of claim 7, wherein the pawl includes an anti-translation protrusion.

11. The system of claim 10, wherein:

the anti-translation protrusion is rotated into a slot of the imaging device as the pawl rotates from the first position to the second position; and the anti-translation protrusion is located in the slot to prevent translational motion of the valve housing in response to the pawl being at the second position.

12. A print substance supply, comprising:

a valve housing, including a first wedge and a second wedge;

a pawl, including:

an anti-rotation surface that contacts the first wedge to prevent rotation of the valve housing in response to the valve housing being at a closed position;

an angled surface; and a leaf spring to bias the pawl to a first position in response to the valve housing being at the closed position;

wherein:

the pawl rotates about a pawl axle from the first position to a second position to cause the anti-rotation surface of the pawl to rotate away from the first wedge of the valve housing in response to the angled surface of the pawl contacting a surface of an imaging device in response to a translational motion of the print substance supply towards the imaging device; and the valve housing is rotated from the closed position to an open position such that the anti-rotation surface of the pawl contacts the second wedge.

13. The print substance supply of claim 12, wherein:

the pawl includes an anti-translation protrusion; and the pawl is rotated from the first position to the second position such that the anti-translation protrusion is located in a slot of the imaging device to prevent translational motion of the print substance supply in response to the valve housing being in the open position.

14. The print substance supply of claim 12, wherein in response to the valve housing rotating from the open position to the closed position and in response to a translational motion of the print substance supply away from the imaging device, the pawl is rotated from the second position to the first position such that the anti-translation protrusion is removed from the slot of the imaging device.

15. The print substance supply of claim 14, wherein the leaf spring rotates the pawl from the second position to the first position in response to the translational motion of the print substance supply away from the imaging device.

* * * * *